US008035674B2

(12) United States Patent
Takane

(10) Patent No.: US 8,035,674 B2
(45) Date of Patent: Oct. 11, 2011

(54) IMAGE FORMING APPARATUS

(75) Inventor: Toshiaki Takane, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 682 days.

(21) Appl. No.: 12/176,465

(22) Filed: Jul. 21, 2008

(65) Prior Publication Data

US 2009/0034033 A1 Feb. 5, 2009

(30) Foreign Application Priority Data

Aug. 2, 2007 (JP) ..... 2007-201680

(51) Int. Cl.
*B41J 2/435* (2006.01)
*B41J 2/47* (2006.01)
*G03G 15/01* (2006.01)

(52) U.S. Cl. ..... 347/234; 347/248; 399/301

(58) Field of Classification Search ..... 347/116, 347/229, 234, 240, 248, 251–254; 399/301
See application file for complete search history.

(56) References Cited

U.S. PATENT DOCUMENTS

| | | | | |
|---|---|---|---|---|
| 6,298,586 | B1 * | 10/2001 | Todome | 399/303 |
| 6,408,156 | B1 * | 6/2002 | Miyazaki et al. | 399/301 |
| 7,366,444 | B2 | 4/2008 | Takane | |
| 7,392,002 | B2 * | 6/2008 | Nishikawa et al. | 399/301 |
| 7,800,799 | B2 * | 9/2010 | Kitao | 358/518 |

FOREIGN PATENT DOCUMENTS

| | | |
|---|---|---|
| JP | 11-65208 | 3/1999 |
| JP | 2000-66463 | 3/2000 |
| JP | 2005-227615 | 8/2005 |
| JP | 2006-84579 | 3/2006 |
| JP | 2006-201341 | 8/2006 |
| JP | 2006-201342 | 8/2006 |

* cited by examiner

*Primary Examiner* — Hai C Pham
(74) *Attorney, Agent, or Firm* — Oblon, Spivak, McClelland, Maier & Neustadt, L.L.P.

(57) ABSTRACT

A color-shift correction image is formed in a density D and it is determined whether the color-shift correction image can be detected successfully. If the color-shift correction image can be detected successfully, then the density is decreased. If the color-shift correction image can not be detected successfully, then the density is increased. In this manner, the minimum density is determined.

14 Claims, 5 Drawing Sheets

IMAGE FORMING APPARATUS

CROSS-REFERENCE TO RELATED APPLICATIONS

The present application claims priority to and incorporates by reference the entire contents of Japanese priority document 2007-201680 filed in Japan on Aug. 2, 2007.

BACKGROUND OF THE INVENTION

1. Field of the Invention

The present invention relates to an image forming apparatus that employs an electrophotographic system.

2. Description of the Related Art

In an image forming apparatus such as a color copier and a color laser printer, particularly in a tandem-type image forming apparatus, toner images of four colors, i.e., yellow, cyan, magenta, and black are sequentially transferred in a superimposing manner onto a recoding medium such as a belt or a sheet. The toner images of different colors may be relatively displaced due to various reasons. If the toner images of different colors are relatively displaced, toner images of the different colors can not be superimposing in a desired manner resulting in a color shift. Such color shift leads to reduced image quality so that it is necessary to take measures to avoid the color shift.

In a conventional technology such as that disclosed in Japanese Patent Application Laid-open No. H11-65208, the color shift is corrected in the following manner. That is, the toner images of yellow, cyan, magenta, and black for correction are formed onto a conveying belt that conveys a recoding sheet, and a detector optically detects the toner images. Furthermore, an amount of displacement between the color toner images is determined based on a result of the detection by the detector, and an exposing start time by an exposing unit is adjusted.

However, in the above conventional technology, toner is consumed for forming the toner images for correction, so that lesser images can be formed with the same amount of toner or extra toner is required for forming the same number of images.

SUMMARY OF THE INVENTION

It is an object of the present invention to at least partially solve the problems in the conventional technology.

According to an aspect of the present invention, there is provided an image forming apparatus including a plurality of image carriers arranged in a line along a direction of conveying a recording medium; a plurality of charging units that apply a static electric charge on the image carriers; an exposing unit that forms latent images on the image carriers by exposing the image carriers; a plurality of developing units that develop the latent images with toners of different colors for each of the image carriers to form toner images on the image carriers; a conveying unit that conveys the recording medium from one image carrier to a subsequent image carrier; a transfer unit that transfers the toner images onto the recording medium to form a color image; a color-shift-correction-image forming unit that forms color-shift correction images with different colors onto the recording medium by controlling the image carriers, the charging units, the exposing unit, the developing units, and the transfer unit; a detecting unit that optically detects the color-shift correction images on the recording medium; and a color-shift correcting unit that corrects a color shift caused by a displacement between the color-shift correction images transferred onto the recording medium, by controlling the exposing unit based on a relative positional relation between the color-shift correction images, wherein when a color-shift correction succeeds consecutively predetermined times, the color-shift correcting unit decreases a density of the color-shift correction images in a next color-shift correction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The present invention is not limited to these exemplary embodiments.

In the following embodiments, the present invention is applied to a tandem-type color laser beam printer as an image forming apparatus. However the present invention can be applied to any type of image forming apparatuses employing an electrophotographic system such as a color copier and a facsimile.

Figure 2:
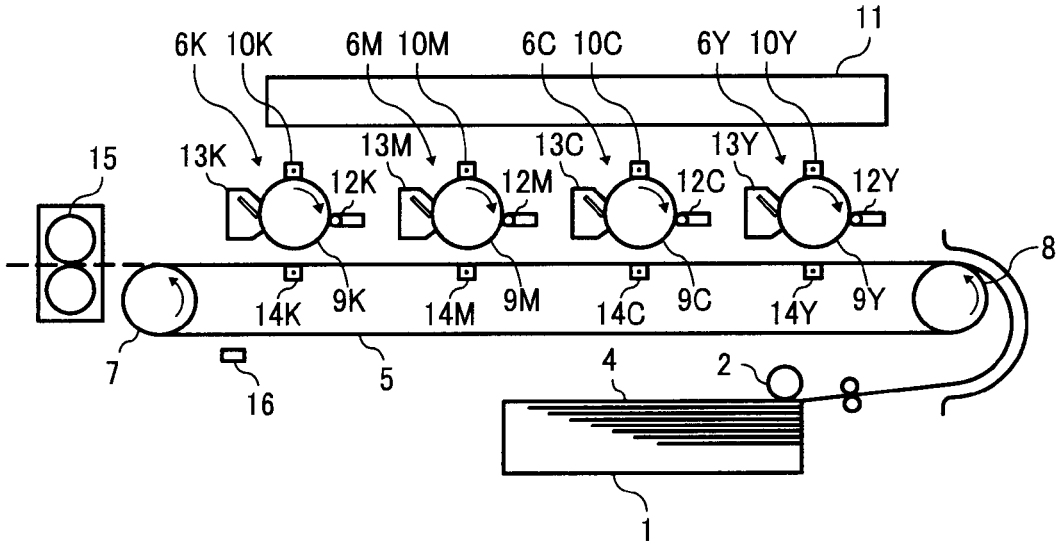
FIG. 2 is a schematic diagram of a relevant portion of the image forming apparatus.
Figure 3:
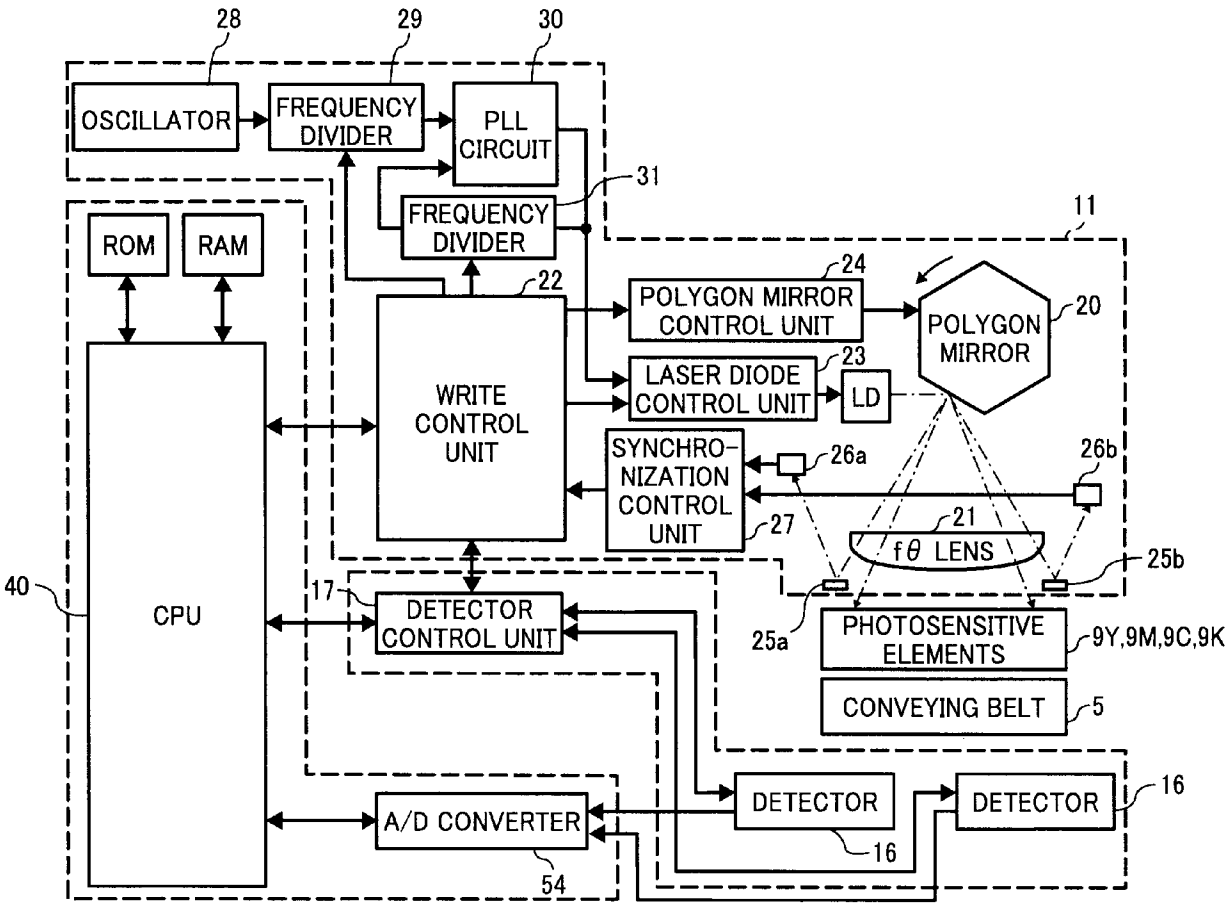
FIG. 3 is a block diagram of the image forming apparatus.

FIG. 2 is a schematic diagram of a relevant portion of the image forming apparatus according the embodiment, and FIG. 3 is a block diagram of a relevant portion of the image forming apparatus.

In the image forming apparatus, image processing units 6Y, 6C, 6M, and 6K are arranged in a line along a conveying belt 5 that conveys a sheet 4. The image processing units 6Y, 6C, 6M, and 6K form color toner images with black (B), yellow (Y), cyan (C), and magenta (M), respectively. The conveying belt 5 is supported with a drive roller 8 that is driven to rotate by a motor (not shown) and a driven roller 7, and rotates in a direction indicated by an arrow in FIG. 2 with the rotation of the drive roller 8. A feed tray 1 that accommodates a stack of the sheets 4 is provided below the conveying belt 5. When forming an image, an uppermost sheet 4 in the feed tray 1 is fed toward the conveying belt 5 by a feeding roller 2 and is electrostatically adsorbed onto the conveying belt 5. The sheet 4 on the conveying belt 5 is then conveyed to the image processing unit 6Y, in which a yellow toner image is formed onto the sheet 4. The image processing units 6Y, 6C, 6M, and 6K include cylindrical photosensitive elements 9Y, 9C, 9M, and 9K as image carriers, charging units 10Y, 10C, 10M, and 10K arranged on a periphery of the photosensitive elements 9Y, 9C, 9M, and 9K, respectively, developing units 12Y, 12C, 12M, and 12K, and photosensitive element cleaning units 13Y, 13C, 13M, and 13K.

Figure 4:
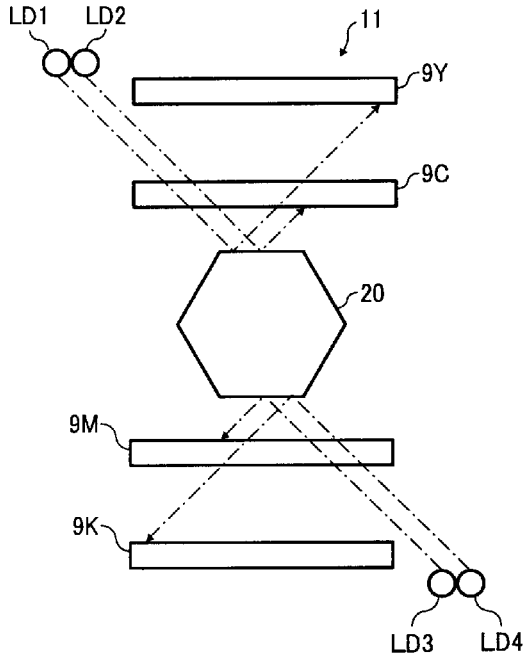
FIG. 4 is a schematic diagram of an exposing unit of the image forming apparatus.

The image forming apparatus includes an exposing unit 11. As shown in FIG. 4, the exposing unit 11 includes four laser sources LD1 to LD4, a polygon mirror 20, and an optical system (not shown). The laser sources LD1 to LD4 correspond to the photosensitive elements 9Y, 9C, 9M, and 9K, respectively. The polygon mirror 20 has a plurality of reflective surfaces that reflect laser lights emitted from the laser sources LD1 to LD4. The optical system includes an fθ lens 21 (see FIG. 3) that focus the laser lights reflected by the polygon mirror 20 on the surfaces of the photosensitive elements 9Y, 9C, 9M, and 9K. The surfaces of the photosensitive elements 9Y, 9C, 9M, and 9K are exposed along axial directions thereof by rotating the polygon mirror 20 and along circumferential directions thereof (a conveying direction of the sheet 4) by rotating the photosensitive elements 9Y, 9C, 9M, and 9K around axis directions. In the exposing unit 11 shown in FIG. 4, the laser lights emitted from the laser sources LD1 and LD2 are reflected concurrently from one reflective surface of the polygon mirror 20 to expose the photosensitive elements 9Y and 9C, and laser lights emitted from the laser sources LD3 and L4 are reflected concurrently from another reflective surface (a reflective surface opposite to the one reflective surface) of the polygon mirror 20 to expose the photosensitive elements 9M and 9K.

For forming a color image, a color separation image signal is subject to a color conversion processing by a CPU 40 in accordance with an intensity level to be converted into a color image data of black (K), magenta (M), yellow (Y), and cyan (C), and the color image data is output into a write control unit 22 of the exposing unit 11. The color separation image signal is pre-provided from a device such as a color imager reader and a printer driver of a personal computer.

Upon starting the image formation, the surfaces of the photosensitive elements 9Y, 9C, 9M, and 9K are uniformly charged with the charging units 10Y, 10C, 10M, and 10K in darkness. The write control unit 22 then causes a laser diode control unit 23 to emit laser beams modulated based on color image data for each color received from the CPU 40 from the laser sources LD1 to LD4, and causes a polygon mirror control unit 24 to rotate the polygon mirror 20. As a result, a pattern corresponding to the color image data is exposed onto each of the surfaces of the photosensitive elements 9Y, 9C, 9M, and 9K, so that electrostatic latent images are formed thereon. A main scanning of the laser beams by the polygon mirror 20 and a sub scanning of the laser beams in a conveying direction of the sheet 4 are synchronized in the following manner. That is, the laser beams that pass through the fθ lens 21 and reflected by mirrors 25*a* and 25*b* are detected by photoreceptors 26*a* and 26*b* such as photo diodes, and a synchronization control unit 27 outputs a synchronization signal to the write control unit 22 based on the output from the photoreceptors 26*a* and 26*b*. The exposing unit 11 includes a conventional clock generator including an oscillator 28 that generates a reference clock signal, a frequency divider 29 that divides the reference clock signal into 1/R, a phase locked loop (PLL) circuit 30, and a frequency divider 31 that divides a signal output from the PLL circuit 30 into 1/L. The write control unit 22 sets the parameters R and L in the frequency dividers 29 and 31 to appropriate values, and the clock generator divides the frequency of the reference clock signal by a frequency dividing number (L/R) and outputs it to the laser diode control unit 23. Therefore, a timing to emit light from the laser sources LDs by the laser diode control unit 23 can be adjusted according to the parameters L and R.

The latent images formed on the photosensitive elements 9Y, 9C, 9M, and 9K are developed by the developing units 12Y, 12C, 12M, and 12K into toner images of respective colors. Then, the toner images are sequentially transferred in a superimposing manner onto the sheet 4 that is conveyed by the conveying belt 5 at image transferring positions at which the photosensitive elements 9Y, 9C, 9M, and 9K oppose transferring units 14Y, 14C, 14M, and 14K, thereby obtaining a color image. The sheet 4 on which the color image is transferred is separated from the conveying belt 5 and is conveyed to a fixing unit 15 where the color image is fixed to the sheet 4. The sheet 4 is then conveyed to a sheet receiving unit (not shown). After transferring the toner images onto the sheet 4, toner remaining on the photosensitive elements 9Y, 9C, 9M, and 9K is removed (i.e., cleaned) by the photosensitive element cleaning units 13Y, 13C, 13M, and 13K that are arranged corresponding to the photosensitive elements 9Y, 9C, 9M, and 9K to be ready for forming a next image.

The toner images of the respective colors are desirably superimposed onto the sheet 4 by setting time to start exposing each of the photosensitive elements 9Y, 9C, 9M, and 9K by the exposing unit 11 so that time at which of the sheet 4 is conveyed to an image transferring position and time at which the toner image on the photosensitive element is moved to the image transferring position coincide with each other for each toner image.

However, because of an error in parallelism of the photosensitive elements 9Y, 9C, 9M, and 9K, an error in distance between axes of adjacent photosensitive elements 9Y, 9C, 9M, and 9K, an error in installation of optical systems such as mirrors, an error in a writing timing, or the like, displacement may occur among the superimposed toner images. Even if there is no error, errors may occur after replacement or maintenance of an image forming unit such as the photosensitive element and the developing unit, or after delivery of the image forming apparatus to a user. Furthermore, because thermal expansion of a mechanism of the apparatus after forming a plurality of images may cause the errors to fluctuate over time, there is a need to make adjustments in a short time.

Japanese Patent Application Laid-open No. H11-65208 and Japanese Patent Application Laid-open No. 2002-244393 disclose five factors for color shifts due to positional displacement among toner images of different colors caused by the errors as stated above. The five factors are a skew, a registration shift in a sub scanning direction, a pitch irregularity in the sub scanning direction, a registration shift in a main scanning direction, and a magnification error in the main scanning direction.

Figure 6:
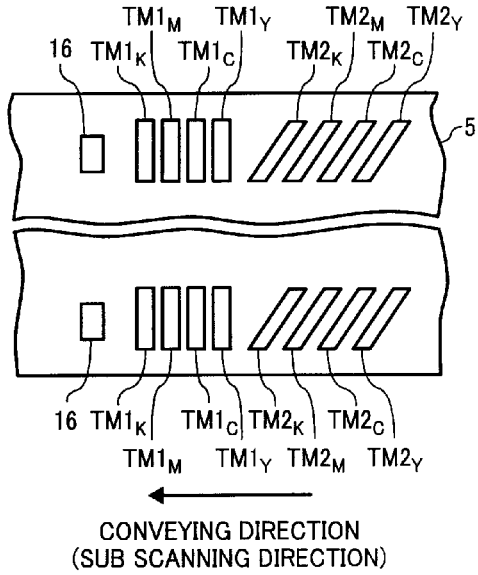
FIG. 6 is a schematic diagram illustrating color-shift-correction toner images.

The image forming apparatus according to the embodiment performs a color-shift correction before forming an actual color image on the sheet 4 similarly to the conventional technologies disclosed in the above documents. Specifically, as shown in FIG. 6, displacement-correction patterns each of which includes color-shift-correction toner images $TMn_Y$, $TMn_C$, TMnM, and TMnK (n=1, 2) for yellow, cyan, magenta, and black are formed on the conveying belt 5 along the borders. The color-shift-correction toner images $TMn_Y$, $TMn_C$, TMnM, and TMnK are detected by a detecting unit to obtain a displacement between the toner images. An amount of displacement occurred among the toner images is calculated in the CPU 40 based on a result of the detection by the detecting unit, and the displacement (color shift) is corrected by a method such as changing a setting of the time to start exposure by the exposing unit 11. Each of the displacement-correction patterns includes strip-shaped images that are parallel to the main scanning direction (hereinafter, "first color-shift-correction toner images $TM1_Y$, $TM1_C$, TM1M, and TM1K") and strip-shaped images that are inclined by 45 degrees with respect to each of the main scanning direction and the sub scanning direction (hereinafter, "second color-shift-correction toner images $TM2_Y$, $TM2_C$, TM2M, and TM2K"). The first color-shift-correction toner images $TM1_Y$, $TM1_C$, TM1M, and TM1K and the second color-shift-correction toner images $TM2_Y$, $TM2_C$, TM2M, and TM2K of each pattern are aligned in the sub scanning direction with a predetermined interval therebetween (see FIG. 6).

Figure 5:
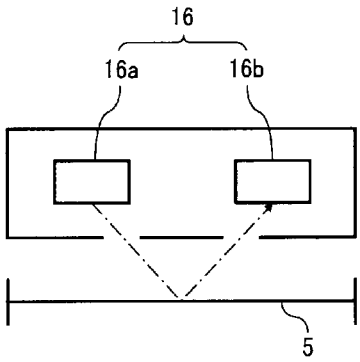
FIG. 5 is a schematic diagram of a detector shown in FIG. 2.

The detecting unit includes three detectors 16 (only two are shown in FIG. 3) that are arranged in the main scanning direction at positions opposing both ends and center of the conveying belt 5. The detecting unit also includes a detector control unit 17 (see FIG. 3). As shown in FIG. 5, each of the detectors 16 includes a light-emitting element 16*a* and a light-receiving element 16*b* that oppose the conveying belt 5. The light-emitting element 16*a* emits light under the control of the detector control unit 17. The light is reflected by a surface of the conveying belt 5, which has a higher reflective index than the toner images, and is received by the light-receiving element 16*b*. The light-receiving element 16*b* outputs a detection signal with a level corresponding to the amount of the received light and outputs the detection signal to an A/D converter 54. The A/D converter 54 converts the detection signal, which is an analog signal, into a digital signal and inputs the digital signal to the CPU 40. When the light is reflected by the color-shift-correction toner images $TMn_Y$, $TMn_C$, TMnM, and TMnK formed on the conveying belt 5, an amount of reflected light decreases, so that an amount of light received by the light-receiving element 16*b* decreases by that amount. Therefore, the detecting unit can detect a timing of passing of the color-shift-correction toner images $TMn_Y$, $TMn_C$, TMnM, and TMnK.

The CPU 40 calculates a displacement amount of each of the above-described five kinds of displacement based on a relative difference (time difference) between a position at which the color-shift-correction toner image TMnK is detected by the detector 16 and positions at which subsequent color-shift-correction toner images $TMn_Y$, $TMn_C$, and TMnM are detected, and a design value of a conveying speed of the conveying belt 5. The CPU 40 then makes the following correction to eliminate the obtained displacement amount (see Japanese Patent Application Laid-open No. 2002-244393). The method for calculating each displacement amount is well known as disclosed in Japanese Patent Application Laid-open No. H11-65208, so that a detailed explanation thereof is omitted.

Correction of skew is explained. The skew is corrected by adjusting a tilt angle of the mirrors 25*a* and 25*b*. The adjustment of the tilt angle of the mirrors 25*a* and 25*b* can be performed by driving a mechanism that can adjust the tilt angle of the mirrors 25*a* and 25*b* with a stepping motor (not shown).

The registration shift in the main scanning direction and in the sub scanning direction, and the pitch irregularity in the sub scanning direction can be corrected such that the CPU 40 sends a command to the write control unit 22 to accelerate or delay a timing of emitting laser lights (write timing) from the light source LD by the laser diode control unit 23 based on a synchronization signal that is output from the synchronization control unit 27 in accordance with each displacement amount.

The magnification error in the main scanning direction can be corrected such that the CPU 40 sends a command to the write control unit 22 to adjust a clock signal that is output from the clock generator in the exposing unit 11 in accordance with a deviation amount of magnification error.

Figure 1:
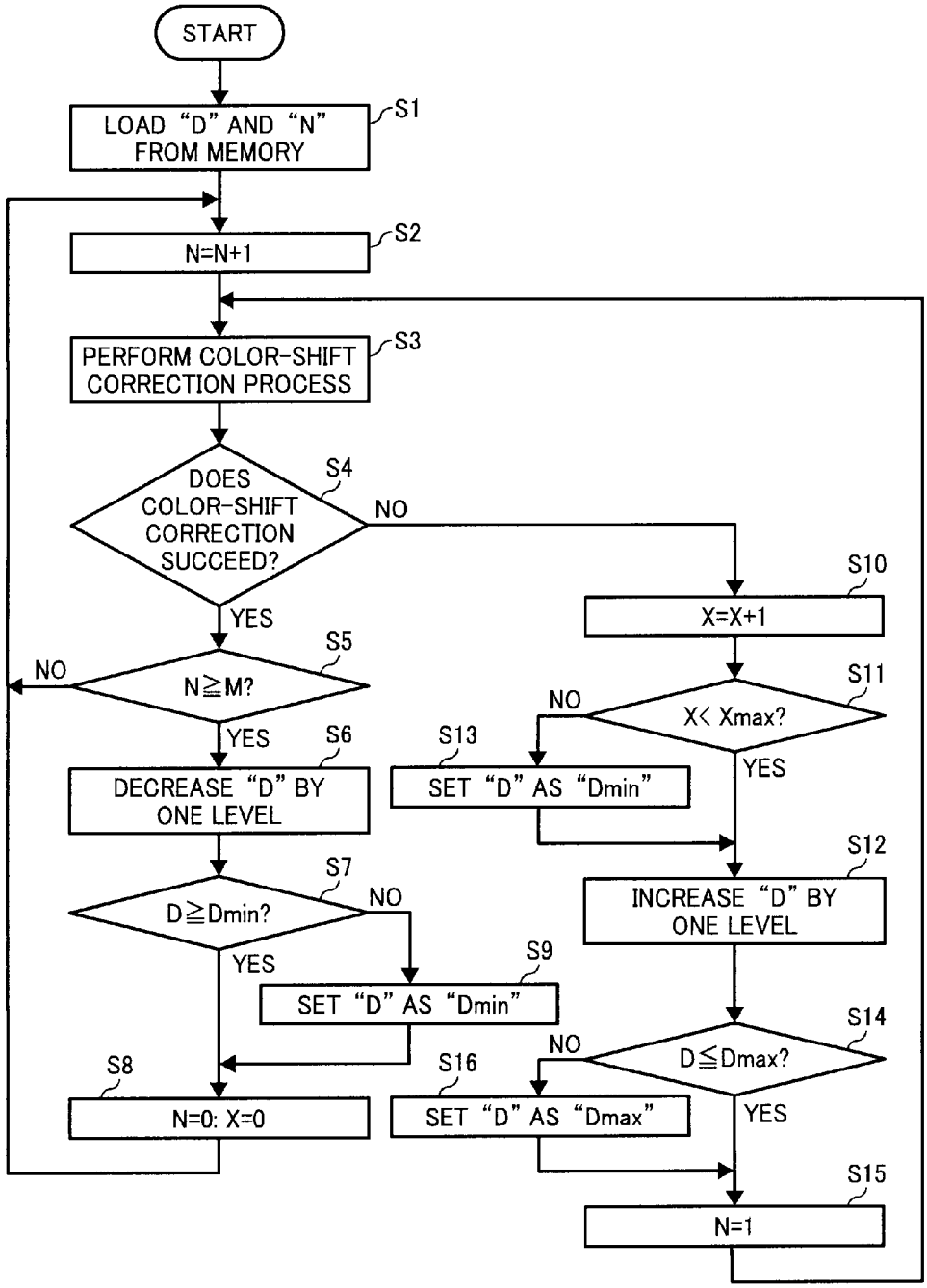
FIG. 1 is a flowchart of the operations performed by an image forming apparatus according an embodiment of the present invention.

A method of adjusting density D of the color-shift-correction toner images $TMn_Y$, $TMn_C$, TMnM, and TMnK (an image forming method) according to the embodiment is explained referring to FIG. 1. The process in the flowchart of FIG. 1 is performed by executing a preprovided computer program for forming color-shift-correction images by the CPU 40 that functions as the color-shift correcting unit and the color-shift-correction-image forming unit. The color-shift correction process is generally performed every several-hundred printings or at the time of turning on the power of the image forming apparatus (color laser beam printer), and is not performed for every printing.

When a color-shift correction process is started, the CPU 40 loads density D and the number of the color-shift correction processes (the number of times of success) "N" stored in a nonvolatile memory (hereinafter, "memory") (Step S1), and the loaded number of the color-shift correction processes "N" is incremented (Step S2). The CPU 40 performs color-shift correction process by forming the color-shift-correction toner images $TMn_Y$, $TMn_C$, TMnM, and TMnK at the loaded density D (Step S3). When the density D is appropriate so that the color-shift-correction toner images $TMn_Y$, $TMn_C$, TMnM, and TMnK can be detected by the detector 16, the CPU 40 determines that the color-shift correction process succeeds. When the density D is too low, i.e. the color-shift-correction toner images $TMn_Y$, $TMn_C$, TMnM, and TMnK are too light, to detect any of the color-shift-correction toner images $TMn_Y$, $TMn_C$, TMnM, and TMnK, the CPU 40 determines that the color-shift correction process fails (Step S4). In each color-shift correction process, the color-shift-correction toner images $TMn_Y$, $TMn_C$, TMnM, and TMnK are considered as a single set and a plurality of the sets are formed at equal intervals on a recoding medium. Only when all the sets are detected by the corresponding detectors 16, the CPU 40 determines that the color-shift correction process succeeds.

When the CPU 40 determines that the color-shift correction process succeeds, the CPU 40 determines whether the number of the color-shift correction processes "N" reaches a predetermined threshold "M" (Step S5). When the number of the color-shift correction processes "N" does not reach the threshold "M" (No at Step S5), the system control is returned to Step S2 to perform the color-shift correction process by incrementing the value of "N". On the other hand, when the number of the color-shift correction processes "N" reaches the threshold "M" (Yes at Step S5), the CPU 40 decreases the density D by one level (Step S6) and the CPU 40 compares the lowered density D with a preset minimum density "Dmin" (Step S7). When the density D is equal to or higher than the minimum density "Dmin" (Yes at Step S7), the system control initializes the number of the color-shift correction processes "N" stored in the memory and the number of times of failure "X" to 0 (Step S8), and the system control is returned to Step S2 to perform the color-shift correction process by incrementing the value of "N". When the density D is lower than the minimum density "Dmin" (No at Step S7), the density D is set as the minimum density "Dmin" (Step S9) and the system control initializes the number of the color-shift correction processes "N" stored in the memory and the number of times of failure "X" to 0 (Step S8) and the system control is returned to Step S2 to perform the color-shift correction process by incrementing the value of "N".

When the CPU 40 determines that the color-shift correction process fails (No at Step S4), the CPU 40 increments the number of times of failure "X" (Step S10). The CPU 40 then determines whether the number of times of failure "X" reaches a predetermined threshold "Xmax" (Step S11). When the number of times of failure "X" does not reach the predetermined threshold "Xmax" (Yes at Step S11), the CPU 40 increases the density D by one level (Step S12). When the number of times of failure "X" reaches the predetermined threshold "Dmax" (No at Step S11), the CPU 40 sets the present density D as a minimum density "Dmin" (Step S13). Thereafter, the CPU 40 increases the density D by one level (Step S12). Furthermore, the CPU 40 compares the increased density D with a maximum density "Dmax" (Step S14). When the density D is equal to or lower than the maximum density "Dmax" (Yes at Step S14), the CPU 40 sets the number of the color-shift correction processes "N" to 1 (Step S15) and the system control returns to Step S3 to reperform the color-shift correction process by forming the color-shift-correction toner images $TMn_Y$, $TMn_C$, TMnM, and TMnK at the density D. When the density D exceeds the maximum density "Dmax" (No at Step S14), the CPU 40 sets the density D as the maximum density "Dmax" (Step S16) and the system control returns to Step S3 to reperform the color-shift correction process by forming the color-shift correction toner images $TMn_Y$, $TMn_C$, TMnM, and TMnK at the density D (="Dmax").

Figure 7:
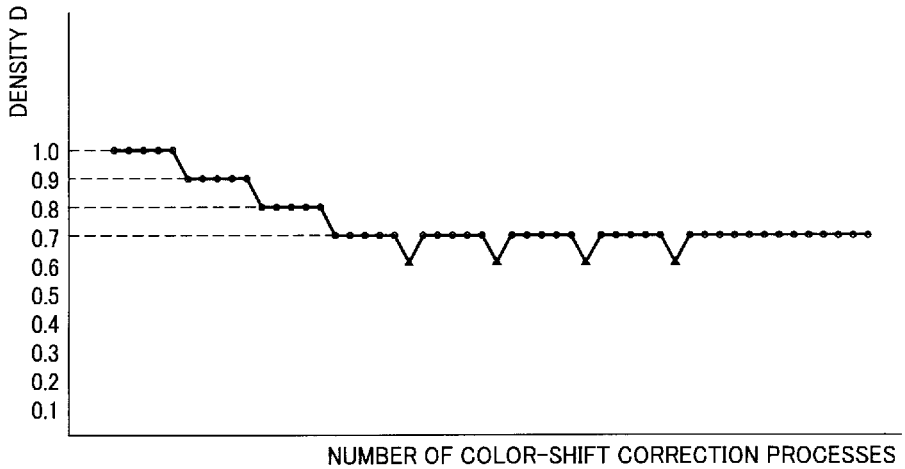
FIG. 7 is a time chart of density D versus the number of color-shift correction processes.

As an example, a transition of the density D over repeated color-shift correction processes is shown in FIG. 7 on the conditions that an initial value of the density D is set to 1.0, the threshold "M" of the number of times of success "N" is 5, an adjustment value (i.e., one level) of the density D is set to 0.1, and a predetermined maximum number of times of failure "Xmax" is 4. In FIG. 7, a success is denoted by a hollow circle and a failure is denoted by a solid triangle.

As shown in FIG. 7, when the density D is the initial value of 1.0 and the color-shift correction process succeeds for the threshold "M" times consecutively (=5 times), the density D is decreased by one level (density D=0.9) (Step S6 to S8). When the color-shift correction process succeeds for "M" times consecutively at the density D=0.9 (Steps S2 to S5), the density D is decreased by one level (density D=0.8) (Step S6 to S8). When the color-shift correction process succeeds for the threshold "M" times consecutively at the density D=0.8 (Steps S2 to S5), the density D is decreased by one level (density D=0.7) (Step S6 to S8). When the color-shift correction process succeeds for the threshold "M" times consecutively at the density D=0.7 (Steps S2 to S5), the density D is decreased by one level (density D=0.6) (Step S6 to S8). When the color-shift correction process fails at the density D=0.6 (Step S4), the density D is decreased by one level (density D=0.7) (Step S10 to S15). When the color-shift correction process succeeds for the threshold "M" times consecutively at the returned density D of 0.7 (Steps S3 to S5), the density D is decreased by one level and sets the density D to 0.6. However, when failed, the density D is decreased by one level to 0.7. Moreover, when the density D is set to 0.6 and the number of times of failure "X" reaches the predetermined "Xmax" (=4), the system control sets the density of 0.7 as the minimum density "Dmin" and thereafter, the density D is kept not to exceed the minimum density "Dmin".

The CPU 40 decreases the density D of the color-shift-correction toner images $TMn_Y$, $TMn_C$, TMnM, and TMnK by one level every time when the color-shift correction process succeeds a predetermined times consecutively, whereby an amount of toner for forming the color-shift-correction toner images $TMn_Y$, $TMn_C$, TMnM, and TMnK can be reduced. More specifically, in a conventional technology, the color-shift-correction toner images $TMn_Y$, $TMn_C$, TMnM, and TMnK are formed always at an initial density D of 1.0. By contrast, according to the embodiment, toner can be saved because the color-shift-correction toner images $TMn_Y$, $TMn_C$, TMnM, and TMnK are formed with a lower toner density (for example, 0.7) than the initial value.

When the color-shift correction process does not succeed for the threshold "M" times consecutively, the density D for forming color-shift-correction toner images $TMn_Y$, $TMn_C$, TMnM, and TMnK for the next color-shift correction process is increased for a predetermined amount from the density D at which the color-shift correction process failure occurs, thereby increasing the possibility that the detector 16 detects the color-shift-correction toner images $TMn_Y$, $TMn_C$, TMnM, and TMnK. Thus, color shift can be surely corrected. When the color-shift correction process does not succeed for the threshold "M" times consecutively owing to any of the color-shift-correction toner images $TMn_Y$, $TMn_C$, TMnM, and TMnK, only the density D of the failure-caused specific color-shift-correction toner image can be increased by one level instead of increasing the density of all the color-shift-correction color toner images. Accordingly, the color-shift correction process can surely be performed while suppressing total toner consumption. Furthermore, toner consumption for each color can be suppressed by adjusting the density D of each of the color-shift-correction toner images $TMn_Y$, $TMn_C$, TMnM, and TMnK (black, yellow, magenta, and cyan). Moreover, according to the embodiment, the color-shift-correction toner images $TMn_Y$, $TMn_C$, TMnM, and TMnK are formed in three lines along the main scanning direction. The toner consumption can be further reduced by adjusting the density D for each line independently.

According to the embodiment, when the counted number of times of failure "X" of the color-shift-correction reaches a predetermined threshold "Xmax", the density D of the color-shift-correction toner images $TMn_Y$, $TMn_C$, TMnM, and TMnK at the subsequent time is set as the lower limit (minimum density "Dmin"). Because the density D of the color-shift-correction toner images $TMn_Y$, $TMn_C$, TMnM, and TMnK from the next color-shift correction process is kept not to exceed the minimum density "Dmin", the color-shift correction process can surely be performed. Furthermore, in the embodiment, the upper limit ("Dmax") is set for the density D, so that the density D does not increase unlimitedly, which prevents excessive increase in toner consumption. When the counted number of times of failure "X" reaches the predetermined value in a state where the density D is set to the maximum density "Dmax", the CPU 40 preferably performs one of a cancelling process of cancelling the next and the subsequent color-shift correction process and a failure determining process of determining as a failure of the image forming apparatus, whichever is preset to suppress the toner consumption for such a failure. It is possible to selectively perform any one of the cancelling process and the failure determining process by a dual in-line package (DIP) switch and the like that is mounted on the image forming apparatus. Moreover, instead of counting the number of times of failure "X", a frequency of the color-shift correction process failure (=X/M) can be obtained. The density D at the level that the frequency (=X/M) reaches a predetermined value, can be set as the minimum density "Dmin".

The initial value of the density D of the color-shift-correction toner images $TMn_Y$, $TMn_C$, TMnM, and TMnK is set at a first use of the image forming apparatus or at replacement of any of the photosensitive elements 9Y, 9C, 9M, and 9K, or the conveying belt 5. The initial value is set in a following manner. The CPU 40 forms a plural sets of the color-shift-correction toner images $TMn_Y$, $TMn_C$, TMnM, and TMnK with the density D of different density levels that gradually decrease from the maximum density "Dmax". The lowest density detectable by the detectors 16 is obtained from the plurality sets of the color-shift-correction toner images $TMn_Y$, $TMn_C$, TMnM, and TMnK. A margin is added to the obtained lowest density, which is determined as the initial value to be stored in a memory. Therefore, the initial value of the density D of the color-shift-correction toner images $TMn_Y$, $TMn_C$, TMnM, and TMnK can be desirably set for every image forming apparatus.

Figure 8:
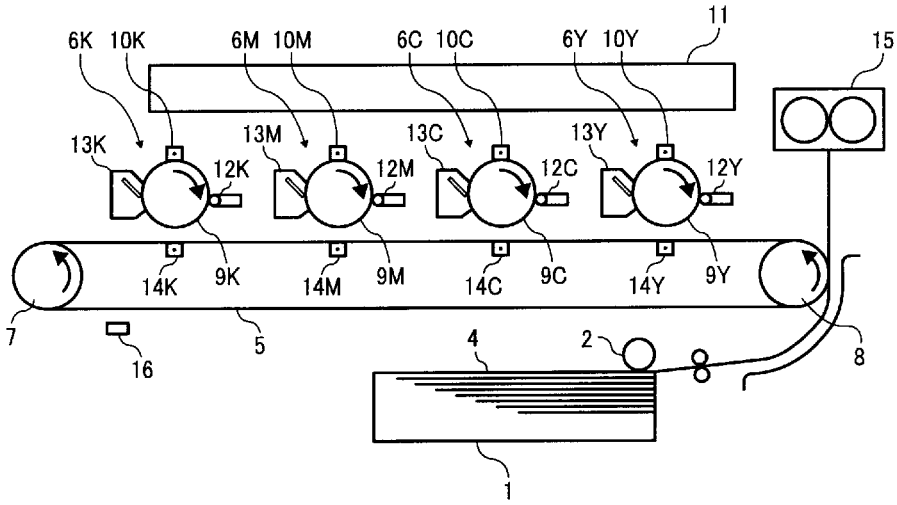
FIG. 8 is a schematic diagram of a relevant portion of an image forming apparatus according another embodiment of the present invention.

In the embodiment, the image forming apparatus employs a system in which a toner image is transferred onto the sheet 4 directly from the image processing unit 6; however, it is not limited thereto. For example, as shown in FIG. 8, a system can also be employed in the image forming apparatus in which all toner images are temporarily transferred onto the conveying belt 5 and then are secondary transferred onto the sheet 4 from the conveying belt 5.

According to one aspect of the present invention, toner consumption can be suppressed while the color-shift correction is surely performed.

According to anther aspect of the present invention, the color-shift correction is surely performed.

According to still anther aspect of the present invention, total toner consumption can be suppressed while the color-shift correction is surely performed.

According to still anther aspect of the present invention, unlimited density increase of the color-shift-correction toner images can be prevented.

According to still anther aspect of the present invention, even when the color-shift correction process does not succeed due to a failure of an apparatus or the like, the toner consumption can be suppressed.

According to still anther aspect of the present invention, density of the color-shift-correction toner images can be set to a desirable value for every apparatus.

According to still anther aspect of the present invention, a toner consumption amount can be suppressed for every color.

According to still anther aspect of the present invention, even by turning the image forming apparatus ON and OFF, the density of the color-shift-correction toner images can be desirably adjusted.

According to still anther aspect of the present invention, whether the color-shift correction process succeeds is determined promptly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image carriers arranged in a line along a direction of conveying a recording medium;

a plurality of charging units that apply a static electric charge on the image carriers;

an exposing unit that forms latent images on the image carriers by exposing the image carriers;

a plurality of developing units that develop the latent images with toners of different colors for each of the image carriers to form toner images on the image carriers;

a conveying unit that conveys the recording medium from one image carrier to a subsequent image carrier;

a transfer unit that transfers the toner images onto the recording medium to form a color image;

a color-shift-correction-image forming unit that forms color-shift correction images with different colors onto the recording medium by controlling the image carriers, the charging units, the exposing unit, the developing units, and the transfer unit;

a detecting unit that optically detects the color-shift correction images on the recording medium; and a color-shift correcting unit that corrects a color shift caused by a displacement between the color-shift correction images transferred onto the recording medium, by controlling the exposing unit based on a relative positional relation between the color-shift correction images, wherein when a color-shift correction succeeds consecutively predetermined times, the color-shift correcting unit decreases a density of the color-shift correction images in a next color-shift correction.

2. The image forming apparatus according to claim 1, wherein when the color-shift correction does not succeed consecutively the predetermined times, the color-shift-correction-image forming unit increases the density of the color-shift correction images in a next color-shift correction.

3. The image forming apparatus according to claim 1, wherein when the color-shift correction does not succeed consecutively the predetermined times for any one of the color-shift-correction images, the color-shift-correction image forming unit increases the density of the color-shift-correction image in a next color-shift correction for which the color-shift correction did not succeed.

4. The image forming apparatus according to claim 1, wherein when number of failures of the color-shift correction with color-shift-correction images having a first density that is counted by the color-shift-correction-image forming unit reaches a predetermined number, the color-shift-correction-image forming unit sets the first density as a lower limit and keeps a density in next and subsequent color-shift corrections not to exceed the lower limit.

5. The image forming apparatus according to claim 1, wherein the color-shift-correction-image forming unit determines a frequency of a failure of the color-shift correction, sets a first density when the frequency reaches a predetermined value as a lower limit, and keeps a density in next and subsequent color-shift corrections not to exceed the lower limit.

6. The image forming apparatus according to claim 1, wherein the color-shift-correction-image forming unit sets an upper limit of the density of the color-shift correction images and keeps the density not to exceed the upper limit.

7. The image forming apparatus according to claim 1, wherein when number of failures of the color-shift correction with a density of color-shift-correction images set to an upper limit that is counted by the color-shift-correction-image forming unit reaches a predetermined number, the color-shift-correction-image forming unit performs a predetermined one of a process of cancelling next and subsequent color-shift corrections and a process of determining as a failure of the image forming apparatus.

8. The image forming apparatus according to claim 1, wherein when determining an initial value of the density of the color-shift correction images, the color-shift-correction-image forming unit forms the color-shift-correction images at a plurality of density levels that gradually decrease from an upper limit, and determines the initial value based on a result of detection of the color-shift correction images by the detecting unit.

9. The image forming apparatus according to claim 8, wherein when using the image forming apparatus for a first time or replacing the recording medium or at least one of the image carriers, the color-shift-correction-image forming unit determines an initial value of the density of the color-shift correction images.

10. The image forming apparatus according to claim 1, wherein the image carriers and the developing units are provided for every plurality of colors, and the color-shift-correction-image forming unit adjusts a density of the color-shift correction images for each of the colors.

11. The image forming apparatus according to claim 1, wherein the color-shift-correction-image forming unit forms a plurality sets of the color-shift correction images in a direction crossing a conveying direction of the recording medium and adjusts a density of each of the plurality sets of the color-shift correction images independently.

12. The image forming apparatus according to claim 1, wherein the color-shift-correction-image forming unit includes a nonvolatile memory to store a density of the color-shift correction images when the color-shift correction succeeds consecutively predetermined times.

13. The image forming apparatus according to claim 1, wherein the color-shift-correction-image forming unit sets a distance between the color-shift correction images of each color to be constant.

14. The image forming apparatus according to claim 1, wherein the color-shift-correction-image forming unit determines as a success when the detecting unit detects the color-shift correction images and determines as a failure when the detecting unit does not detect the color-shift correction images.

* * * * *